US007607860B2

(12) United States Patent
Novak

(10) Patent No.: US 7,607,860 B2
(45) Date of Patent: Oct. 27, 2009

(54) CONTINUOUS METHOD AND APPARATUS FOR MICROWAVE-BASED DRYER

(76) Inventor: John F. Novak, 34 N. Chestnut St., Fredericktown, OH (US) 43019

( * ) Notice: Subject to any disclaimer, the term of this patent is extended or adjusted under 35 U.S.C. 154(b) by 323 days.

(21) Appl. No.: 11/228,173

(22) Filed: Sep. 16, 2005

(65) Prior Publication Data

US 2006/0078383 A1 Apr. 13, 2006

Related U.S. Application Data

(60) Provisional application No. 60/522,337, filed on Sep. 16, 2004.

(51) Int. Cl.
*E01C 23/14* (2006.01)

(52) U.S. Cl. ..... 404/77; 404/79; 404/95; 34/289

(58) Field of Classification Search ..... 404/77, 404/79, 95; 34/289
See application file for complete search history.

(56) References Cited

U.S. PATENT DOCUMENTS

| | | | | |
|---|---|---|---|---|
| 4,252,487 | A * | 2/1981 | Jeppson | 404/77 |
| 4,319,856 | A * | 3/1982 | Jeppson | 404/79 |
| 5,899,630 | A * | 5/1999 | Brock | 404/79 |
| 6,618,957 | B2 * | 9/2003 | Novak et al. | 34/264 |
| 2002/0046474 | A1 * | 4/2002 | Novak et al. | 34/259 |
| 2002/0090268 | A1 * | 7/2002 | Haller | 405/128.85 |
| 2002/0150425 | A1 * | 10/2002 | Bodish | 404/95 |

* cited by examiner

*Primary Examiner*—Gary S Hartmann
(74) *Attorney, Agent, or Firm*—Louis F. Wagner; Hahn Loeser + Parks LLP

(57) ABSTRACT

The invention relates to a method and a movable apparatus for utilizing microwave energy to dry materials (optionally with sterilization) by the direct application of bifurcated out-of-phase microwave energy.

14 Claims, 4 Drawing Sheets

CONTINUOUS METHOD AND APPARATUS FOR MICROWAVE-BASED DRYER

TECHNICAL FIELD

The invention described herein pertains generally to a continuous method to utilize microwave energy to dry materials, e.g., roadbeds after the initial cut or in final preparation for paving, as well as an apparatus effective for the same.

The combination of soil, which is typically a mixture of silt, clay, sand and aggregate materials, and water are dried by the direct application of bifurcated out-of-phase microwave energy, resulting in a reduced moisture content roadbed in one application. In a second application, asphalt patching and repair of an existing asphalt roadbed is achieved without the application of any external heat while yet in a third application, spalling of concrete in preparation for repaving is attained. In a fourth embodiment, agricultural fields are prepared for the next planting season by reducing herbicides, insecticides in addition to a total insect and pathogen kill without affecting the beneficial nitrogen and phosphorus which can be plowed back into the soil with the fragile ash which remains after the remaining stubble in the fields is treated in accordance with the invention.

BACKGROUND OF THE INVENTION

Currently two primary methods of roadbed preparation are employed: 1) excavating the moist or wet roadbed and mixing lime thoroughly with the soil to allow the exothermic reaction between the lime and water to release sufficient heat to dry the soil and 2) use a process employing jet engine exhaust to directly heat the roadbed from the top down. Both processes are labor intensive and have very high initial capital equipment and operating costs. In addition, lime dust can cause serious skin burns to operating personnel. Further, both processes require days for drying a mile of typical roadbed, while the microwave apparatus described in this invention will provide a dry roadbed, suitable for paving, usually within one day. One can readily see the impact in re-drying efforts expended in time, fuel and/or lime necessary after a rainstorm. It should also therefore be apparent that utilization of this invention returns the wet roadbed to a surface suitable for paving in less time. As this invention only requires one person for operation, combined with less fuel consumption and without lime addition, operating costs are substantially less.

It has been estimated that a typical jet engine-based system is labor-intensive at a cost of approximately $100,000/mile. Lime mixing operations are also labor-intensive at a cost of approximately $84,000/mile. Both operations take about 7-10 days per mile.

Weather obvious plays a critical role in preparation and installation of roadbeds throughout the typical 6-8 month season. Road construction delays due to inclement weather, results in escalating costs. Many efforts to substantially improve efficiency or reduce costs have failed to meet their objectives either from an economic or technical point of view. Microwaves have been used to reheat and dry various materials, due to the excitation of the water molecules contained within the sample. Heating typically occurs from the inside out. Convection heating has also been used to reheat and dry various materials, and heating typically occurs from the outside in. It is well known that hot air is capable of holding more moisture than cold air. The combined effect of applying microwave energy and hot recirculating air is the most effective method of drying. This invention will improve roadbed drying efficiency and extend the roadbed construction operation to typically 10-11 months.

Therefore, what is needed is a microwave-based continuous drying process without any pretreatment of the roadbed which only needs one operator/driver with a completion of one mile of roadbed preparation in about four hours time.

There is also a need for support in the field of agriculture as a replacement for the traditional approach of burning the remaining "stubble" which is seen in the fields post-harvesting. By the surface application of microwaves, this stubble can be reduced to a fragile ash which can more easily be plowed back into the soil without any negative impact on the desirable nitrogen and phosphorus.

SUMMARY OF THE INVENTION

In accordance with the present invention in one aspect, there is provided a combined microwave/convection heating; e.g., engine exhaust gas from the diesel engines in the crab tractor and engine generator package recirculated through insulated ducting into the microwave applicator to more efficiently and economically produce dry roadbeds of either aggregate (gravel) or soil in preparation for paving. The invention provides a process for the reduction of moisture content, the process comprising the direct application of microwave energy to the roadbed with simultaneous convection heating from engine exhaust gas, and exhausting the moisture-laden air to atmosphere, resulting in roadbed moisture reduction in a predictable, controlled manner.

It has been determined that introduction of the engine exhaust gas—via a forced draft fan—through double-insulated duct into a directional finned structure around the perimeter of the applicator base—just above the surface of the roadbed—and then exhausting the moisture-laden air via exhaust blowers through double-insulated duct to atmosphere provides a method to eliminate condensation at ground level. The double-insulated duct input is circular from the engine exhaust manifold and diffused through a series of rectangular openings at the base of the applicator. Similarly, the exhaust of moisture-laden air from the applicator is ducted through a series of rectangular openings near the top of the applicator and converged into a circular duct through an exhaust blower to atmosphere. Any or all of these methods of utilization results in reduced moisture, which further contributes to improved overall efficiency of operation.

Though the vehicle containing the roadbed treatment apparatus is classified as an off-road vehicle and is not subject to the stringent environmental air emissions requirements, an extra benefit of mixing the exhaust gas with water vapor is the result of improved exhaust air emissions. The Air Quality Division of the Environmental Protection Agency (EPA) checks standard vehicles for emissions of Hydrocarbons (HC), Particulates, Nitrogen Oxides ($NO_x$), Sulfur Oxides ($SO_x$) and Carbon Monoxide (CO). In this process, $NO_x$ emissions are reduced due to increased residence time between combustion and discharge to atmosphere, as well as absorption and breakdown of $NO_x$ molecules by microwave excitation.

It is an object of this invention to overcome the limitations of the prior art and to provide a means of drying roadbeds more efficiently, along with reduced labor, operating and capital costs.

It is another object of this invention to provide an improved method for using both microwave and convection technologies.

It is still another object of this invention to provide an improved method for patching holes in existing asphalt pavement using microwave and radiant convection technologies.

It is an additional object of this invention to provide an improved method for spalling concrete in preparation for resurfacing or repaving concrete roadbeds.

It is yet another object of this invention to provide an improved design for the distribution of the microwave energy within the applicator, resulting in more uniform drying of the roadbed below the applicator.

It is still yet another object of this invention to provide a variable speed tractor with on-board cooling system to dissipate the heat of the magnetrons that power the microwave.

It is a further object of this invention to provide an improved process post-harvest which destroys harmful herbicides and pesticides and beneficially reduces fibrous stubble to fragile ash for subsequent plowing back into the soil.

Finally, it is the objective of this invention to be self-contained for demonstration of the above methods to a potential customer at an apartment or condominium complex under development, parking lot paving project, or new highway construction without additional equipment.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
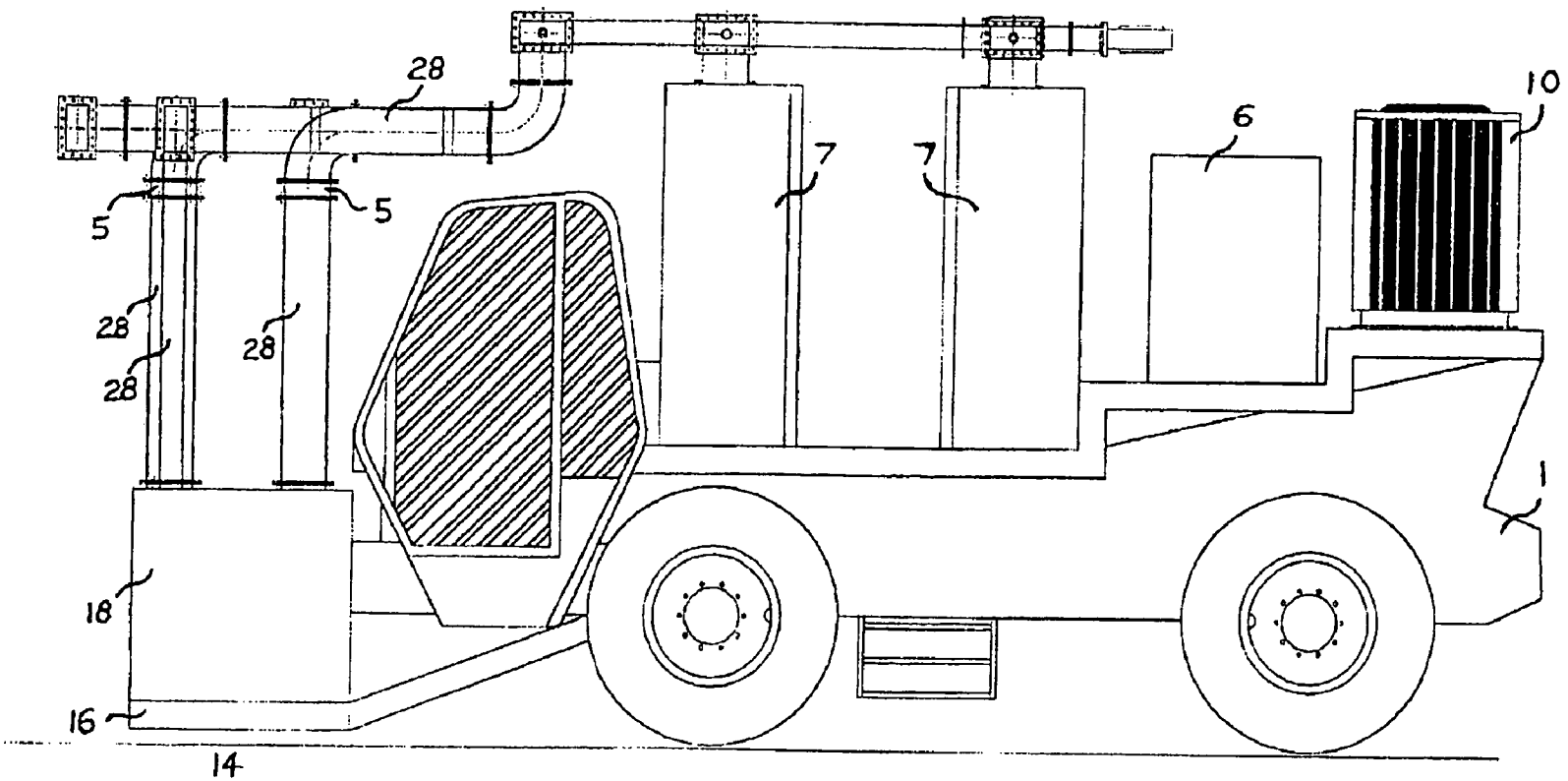
FIG. 1 is a side elevational view of a single unit for use in the present invention.

Referring now to the drawings wherein the showings are for purposes of illustrating the preferred embodiment of the invention only and not for purposes of limiting the same, the figures show a drying apparatus (for use in one embodiment on a roadbed) which employs microwaves. In the following description, similar features in the drawing have been given similar reference numerals. The roadbed drying application for saturated soil will typically contain 25-30% moisture, while the roadbed drying application for limestone/gravel will typically contain 20-25% moisture. Concrete roadbed will contain typically less than 10% moisture. The invention will reduce the moisture content of soil roadbed to ≦15%, limestone/gravel roadbed to ≦15%, and concrete pavement to ≦1-2% plus spalling achieve effects.

The roadbed moisture content and specific soil analysis determine the amount of power required and penetration depth of the application. As an example, microwave penetration depth for a roadbed dryer in a saturated soil application is typically 8-12 inches, while microwave penetration depth for a roadbed dryer in a limestone/gravel application is typically 12-16 inches. Microwave penetration depth for cured concrete in a spalling application approaches 16-24 inches.

Microwave penetration depth is defined as, the depth that 63.2% of the applied microwave energy is absorbed by the dielectric load between the roadbed surface and the plane of the stated depth, whether it be saturated soil, limestone/gravel or cured concrete. The remaining 36.8% of the applied microwave energy will be absorbed by the dielectric load at a depth exceeding the stated penetration depth.

Microwave energy absorption results from the dielectric loss factor of the material, which causes the power dissipation within the roadbed material. It is the power dissipation throughout the material exposed to the microwave energy, which causes the power density of the applied microwave energy to decrease with increasing depth. Mathematically, the above relationships can be expressed by the well known approximation for determining penetration depth as: $D_p \approx (\lambda_0\sqrt{\epsilon'})/(2\pi\epsilon'')$, where: $\lambda_0$=applied wavelength of the propagating microwave frequency in free space, $\epsilon'$=relative permittivity, $\pi$=3.14159, and $\epsilon''$=loss factor. As the roadbed dries from the bottom upward, the loss factor decreases, resulting in an increase in penetration depth.

As illustrated in FIG. 1, the multi-mode microwave applicator assembly 12 is mounted on the front of the commercially available vehicle, such as a crab tractor 1 with four-wheel steering to facilitate a short turning radius. This microwave applicator is a single rectangular cavity 18 with a width of 8 feet, height of 4 feet and with multiple zones containing input feeds from multiple sources of microwave energy. The entry ports 20 and 22 (see FIG. 2) and one set of converging exit duct 24 (not shown) are in longitudinal communication with the roadbed material 14 illustrated in FIG. 1, said material being of a varying composition of silt, clay, sand and aggregate materials and water.

Figure 2:
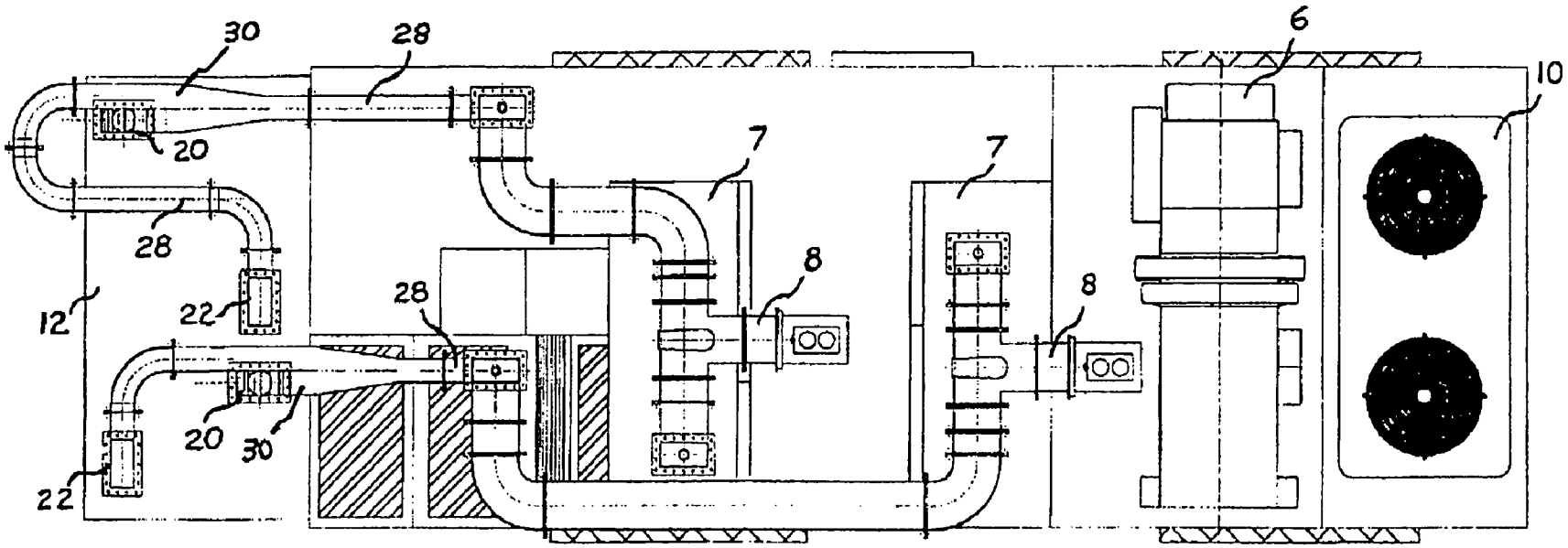
FIG. 2 is a top view of a single unit for use in the present invention.

While only one microwave applicator is shown in FIGS. 1 and 2, in roadbed applications, the internal geometry; i.e., length and width, as well as the height of the active microwave area, may be modified to accommodate specific requirements of the volumetric workload to be processed. The active area of the demonstration applicator is 4 feet high.

The microwave energy is transferred from the microwave generator to the applicator via a waveguide 28 and exits the same via a bifurcated waveguide assembly 30. The source of the microwave energy in the generator is a magnetron, which operates at frequencies which range from 915 mega-Hertz (MHz) to 2450 MHz, more preferably from 915 MHz to 1000 MHz, and most preferably at approximately 915 MHz+/−10 MHz. The lower frequencies are preferred over the more common frequency of 2450 MHz typically used in convention microwave ovens due to increased magnetron power, availability and penetration depth into the roadbed material at 915 MHz, along with a significant increase in operating efficiency from 60 to 88%.

In the event that all of the applied microwave energy is not absorbed by the roadbed material, some of the microwave energy is reflected from the roadbed (load) toward the magnetron. This reflected microwave energy is absorbed by a device known as a 3-port ferrite circulator. This circulator is designed to absorb 100% of the microwave energy generated by the magnetron to prevent damage to, and destruction of, the magnetron. Each microwave generator transmits its energy via a waveguide into the common, series-connected microwave zones or applicator. In a preferred embodiment, each microwave generator operates at a center frequency of 915 MHz +/−10 MHz.

The microwave energy is coupled from the microwave generator, through a bifurcated waveguide assembly, through a microwave pressure window 5 made of fused quartz, into the applicator via two waveguides, which serve as rectangular conduits into the applicator. The microwave pressure window serves to prevent any vapors in the applicator from returning through the hollow waveguide to the microwave generator. The fused quartz window is microwave-transparent.

The waveguide entry into the applicator is via a three-ported bifurcated waveguide assembly, which equally divides the electromagnetic wave of microwave energy, prior to the two-plane entry into the top of the applicator, while maintaining electric field dominance. The waveguide inputs to the applicator from the bifurcated waveguide assembly are in the same plane at the top of the applicator, but one plane is oriented along the x-axis, while the other plane is oriented along the y-axis. The bifurcated waveguide assemblies, in conjunction with the configuration of the microwave applicator input ports, are designed so as to produce microwaves, which are 90° out of phase. This results in the generation of multiple modes of microwave energy within the applicator and elimination of the requirement for mode stirrers, while providing a more uniform distribution of the applied microwave energy throughout the applicator.

The microwave energy produced by the microwave generator is single-plane linear-polarized wave, which is propagated into a standard WR-975 rectangular waveguide, where the microwave energy enters a bifurcated waveguide with each section of equal cross-sectional area. One output connects to a right angle waveguide section, from which the microwave energy enters directly into the applicator. The other output is presented to a two-section long-radius, right angle waveguide section, which accomplishes the turning of the microwave energy path 180°, while maintaining electric field dominance. The microwave energy enters a short straight section and another long radius, right angle waveguide section. The microwave energy is then coupled into a right angle waveguide section and enters directly into the applicator. Although the waveguide entries into the applicator are in the same plane at the top of the applicator, the orientation of the two waveguide entries, relative to the centerline of the applicator, are in phase quadrature or 90° to each other. Two microwave sources linear-polarized waves combine vectorially to form a circularly polarized electromagnetic wave. One waveguide entry section to each applicator entry point is parallel to the direction of travel over the roadbed material, while the other is perpendicular to the direction of travel over the roadbed material. The other significant feature of this design is that the distance from the output from the bifurcated waveguide, which couples the microwave energy to the applicator entry port parallel to the direction of roadbed travel, is physically much longer that the output feeding the perpendicular port. This additional length results in a different characteristic impedance at the applicator entry point, a time delay in the microwave energy reaching the applicator entry point, and a relative phase shift in the energy wave itself. As stated previously, the generator operates at a nominal center frequency of 915 MHz, with an allowable variation of +/−10 MHz. At this frequency, the effects of additional waveguide lengths and bends present a very noticeable change in the phase relationships due to the impedance mismatch. However, in this invention, the impedance mismatch, along with the frequency of operation is a significant contribution to the microwave energy mixing within the applicator, allowing more even energy distribution throughout the entire applicator load.

Since the applicator is open at the base, some microwave energy could propagate into the surrounding area, resulting in radio frequency (RF) interference and a hazard to personnel. To prevent leakage of the microwave energy from the applicator, a device known as an RF trap 16, containing a matrix of grounded ¼—wavelength RF stubs (antennae), with ¼—wavelength spacing between the RF stubs, is installed around the perimeter at the base of the applicator to insure attenuation of microwave energy for compliance with leakage specifications of <10 mW/cm$^2$.

Figure 3:
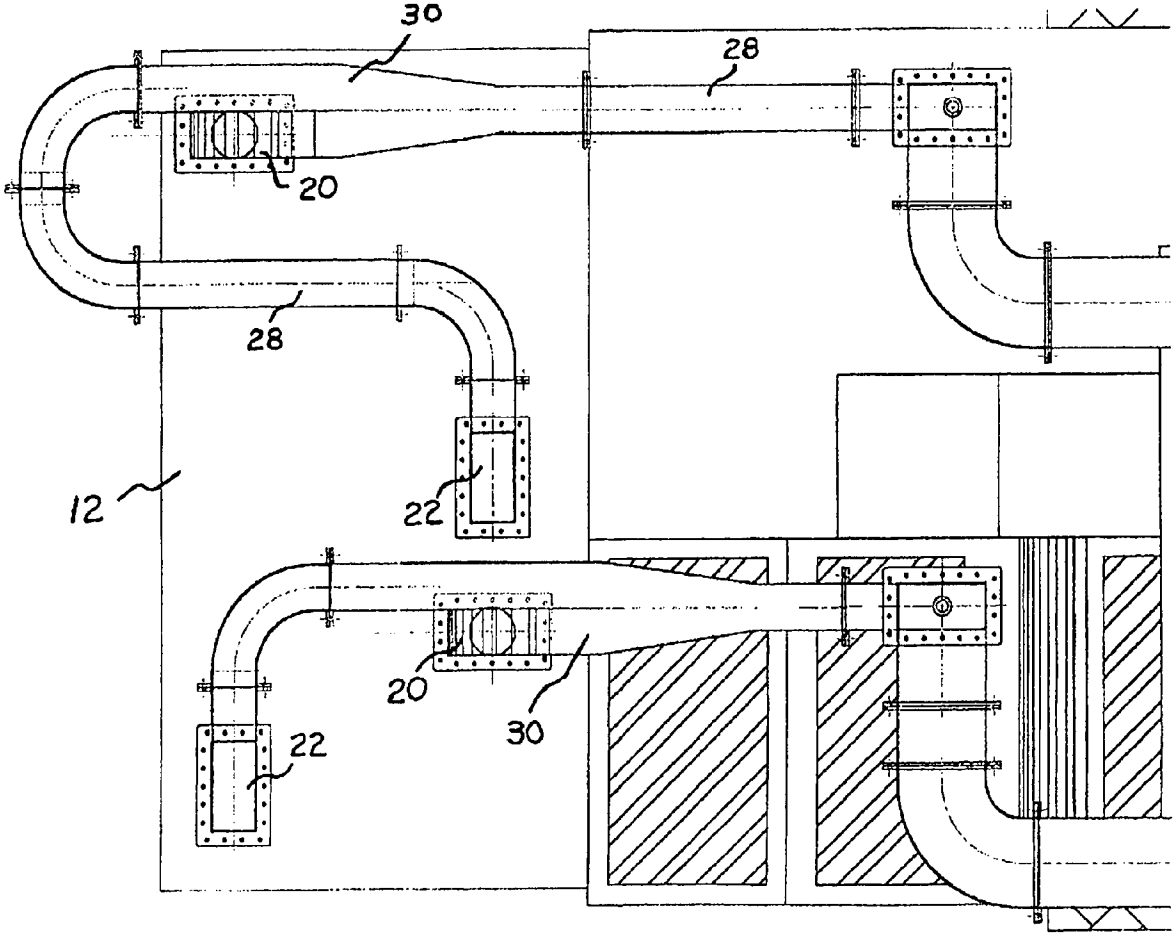
FIG. 3 is an exploded top view showing two sets of bifurcated waveguide assemblies above the applicator.
Figure 4:
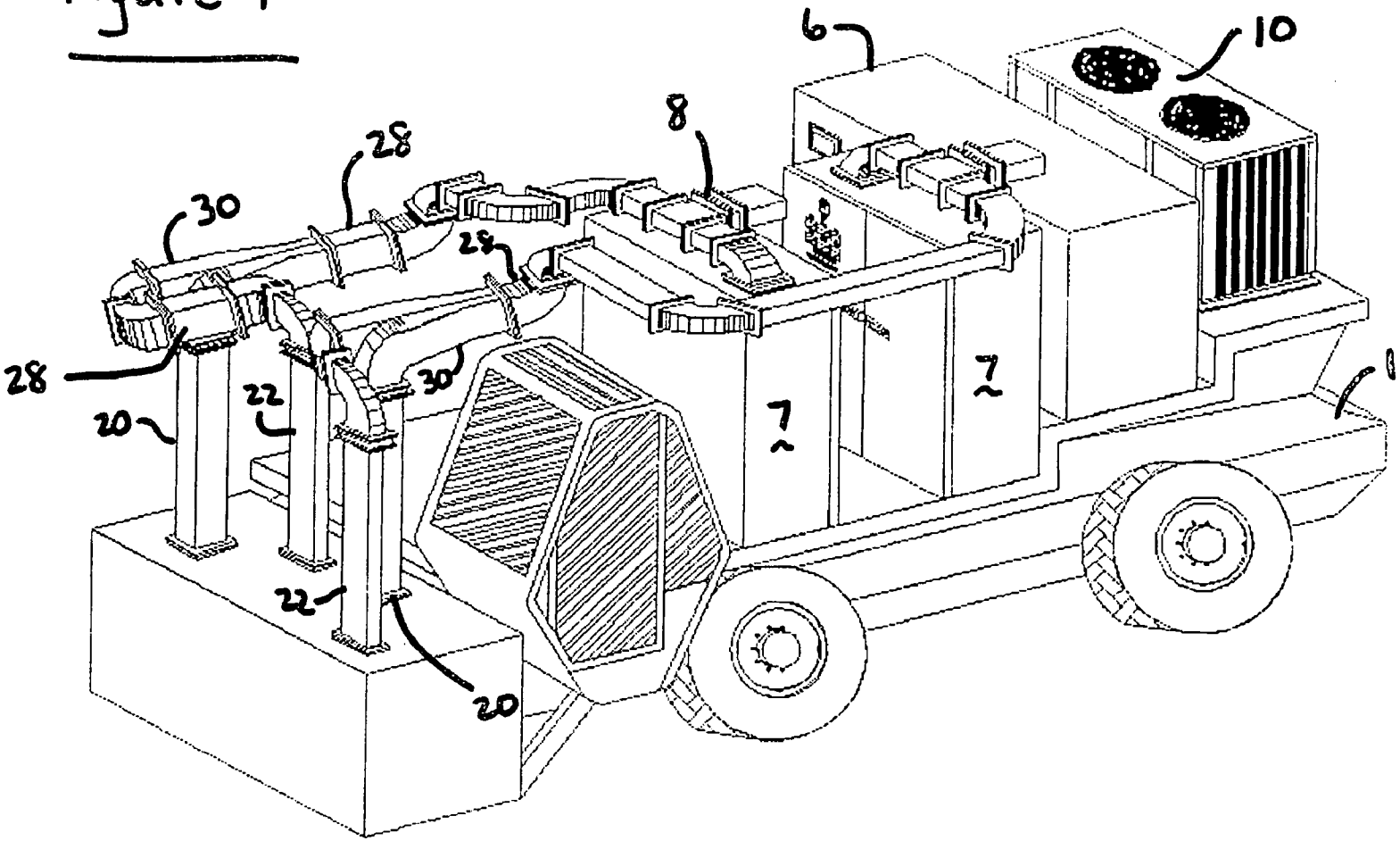
FIG. 4 is a perspective view of the continuous mobile dryer unit.

The active area in the microwave applicator typically consists of a rectangular cavity, measuring twenty-four feet long, by four feet wide and four feet high designed specifically for the microwave energy coupled from two microwave generators (shown in FIG. 3) and two bifurcated waveguide assemblies, which results in four sources of microwave energy to the applicator and more uniform distribution.

The applicator also contains an exhaust duct 32 (not shown) for the moisture and heated air to escape to the atmosphere. The two microwave generators primarily consist of two magnetrons and, each rated at 100 kW continuous power, two circulators with water loads 8, each capable of absorbing 100% power generated by their respective magnetrons, and two switched-mode power supplies, each operating at 480 Volts, 3-phase and capable of delivering 120 amperes (amps) to each magnetron. Power for the entire microwave system is provided by the on-board diesel engine-generator package 6.

The only additional requirement is cooling water in the amount of five gallons per minute per minute per magnetron and four gallons per minute of cooling water per circulator water load, which is provided by the on-board chiller system 10.

Each microwave generator 7 is a two-door enclosure with front door access measuring 80 inches long, 24 inches wide and 84 inches high. The magnetron control enclosure is 32 inches long, 24 inches wide and 84 inches high, while the magnetron power supply enclosure is 48 inches long, 24 inches wide and 84 inches high.

To process additional material or increase the throughput, one may add additional microwave generators, extend the applicator length, or increase vehicle speed. The recirculating exhaust gas from the diesel engines is derived from the combustion of diesel fuel. This invention allows the addition of microwave generators and relative appurtenances in sets of three maximum, along with an extension of the applicator as dimensionally-defined above. The standard design, which supports the majority of roadbed drying applications, contains three modules. For variations in the moisture content of the organic material, the vehicle speed may be adjusted to change the dwell time of the material in the applicator. Vehicle speed control is accomplished by changing the speed setpoint on the touchscreen in the vehicle's operator cab.

In one aspect of the invention, the design of the unit is as a portable demonstration unit, with the microwave generators and control cabinets, chiller and engine-generator mounted on the vehicle deck area and the microwave applicator assembly mounted on the front of the vehicle.

System control is accomplished by the use of a Programmable Logic Controller (PLC) with Input/Output (I/O) modules and an Ethernet communications cable to a Remote Terminal Unit (RTU) or Touchscreen in the vehicle's operator cab. The PLC is mounted in the microwave generator control panel. A PLC to Ethernet communication bus is installed in each microwave generator enclosure, which permits continuous bi-directional communication between the PLC and the operator interface terminal (touchscreen). The PLC program provides continuous sequencing, monitoring and control functions. The PLC program also communicates along an Ethernet bus to display alarm/shutdown status and operating parameters on the RTU. The RTU provides a real time display in both analog and digital format. The summary status touchscreen indicates power output, reflected power, anode current and voltage, filament current, magnet current, generator cabinet temperatures, applicator temperatures, water system temperatures and vehicle speed with corresponding roadbed material process rate.

Additional magnetron protection is insured by a directional coupler circuit, which monitors the reflected power and de-energizes the high voltage to the magnetron. An arc detection system protects the magnetron, three-port circulator and waveguide by de-energizing the high voltage upon detection of arcing within the applicator. Any shutdown parameter, which exceeds the preset level, initiates an immediate shutdown of the high voltage system and enables the safety shutdown system to provide an orderly and controlled shutdown. The safety shutdown system includes both fail-safe hardwired circuitry and programmable shutdown logic, along with local and remote emergency stop buttons to provide maximum protection for operating and maintenance personnel and equipment. Access doors in both the generator and applicator enclosures, main power sources and the high voltage power supplies are provided with fail-safe safety switches and interlocked with the startup sequence in the PLC program and monitor during microwave operation to protect operating and maintenance personnel from exposure to microwave energy and shock hazards. The safety shutdown system interlocked with the PLC will respond to a shutdown command within 10 μS after activation. A main fused-disconnect switch is included with both keyed interlocks and mechanical lockout features. Finally, a grounded bus bar (¼ inch by 2 inches) is provided to insure absolute ground integrity with the diesel-powered generating source to all equipment included with this invention.

This is standard PLC/hardwire ladder logic programming, depicting a Boolean expression for a series shutdown circuit, designed for failsafe operation. The emergency switches are normally closed (push to open), the low level switches must reach their setpoint before operation may be sequenced, and the high level switches will open upon exceeding their setpoint. Any open switch in this series string will cause the master shutdown relay to de-energize, which results in the de-energizing of the high voltage circuits and forces the PLC to effect an immediate and orderly shutdown sequence.

The best mode for carrying out the invention will now be described for the purposes of illustrating the best mode known to the applicant at the time. The examples are illustrative only and not meant to limit the invention, as measured by the scope and spirit of the claims.

EXAMPLE #1

This example 1 was conducted with a commercially-available 1500 Watt microwave oven operating at 2450 MHz in batch mode, with forced hot convection air added via a portable dryer and an exhaust fan to remove the moisture-laden air from the unit. The material met the desired value of reduction in moisture content to 15% or less. It was determined that, for roadbed saturated soils, increasing microwave power levels reduced drying times, while drying rates are reduced as microwave power levels are increased. The demonstration unit was invented to confirm the viability of microwave roadbed drying applications to potential customers prior to purchase. The data presented in the examples reflect roadbed materials of varying consistencies.

TABLE I

Typical Roadbed Soil Material Properties

| Characteristic | Sample #1 | Sample #2 | Sample #3 | Sample #4 |
|---|---|---|---|---|
| Input Moisture Content, % | 35 | 24.4 | 24.2 | 30 |
| Output Moisture Content, % | 15 | 15.0 | 14.0 | 11.0 |
| Density, lb/ft$^3$ | 80 | 130 | 113.5 | 128 |
| Specific Heat, Btu/lb-° F. | 0.24 | 0.208 | 0.212 | 0.21 |
| Relative Permittivity | 20 | 20 | 20 | 20 |
| Dielectric Loss Factor | 0.69 | 1.40 | 1.09 | 1.71 |
| Penetration Depth, inches | 13.72 | 6.56 | 8.42 | 5.38 |
| Operating Speed, miles/hour | 0.24 | 0.25 | 0.25 | 0.25 |
| Characteristics of Soil: Loam, Silt, Clay, Sand, Aggregate | Clay, Aggregate | Sand, Silt, 50/50 Mixture | 64% Sand 36% Clays | Clay, Sand |

While the discussion has focused primarily on roadbed drying, there is no need to limit to such. In fact, it is envisioned that both asphalt patching and concrete spalling applications are contemplated and within the scope of this invention.

Without being held to one theory of operation, or one mode of performance, it is believed that the benefits of the invention are derived at least in part, by introducing microwave excitation of water molecules inside the roadbed material by subjecting the material to high frequency radio waves in the ultra-high frequency (UHF) band. The polar water molecules in the material attempt to align themselves with the oscillating electric field at frequency 915 MHz or approximately every nanosecond. As the molecules cannot change their alignment synchronously with the changing electric field, the resistance to change manifests itself as heat and the moisture trapped within the material is released as water vapor. The heated air flowing through the material converts any surface moisture to water vapor. This efficient release of moisture from the roadbed results in improved drying efficiency. As the invention is designed for automatic operation, with a display in the vehicle's operator cab, no additional personnel are required. The use of this invention results in an immediate increase in drying efficiency over conventional hot gas dryers and lime mixing/blending methods by to employing the combination of microwave and convection oven technologies.

Raw Material Particle Sizing Aspects

The roadbed material treated by this invention is typically in a random sized, ragged, chunk form, with a diameter or thickness of which typically is ½ inch or less, as well as all the way down to fines, such as sand or silt.

Contact Time

The contact time of the roadbed section below the applicator is primarily dependent upon the speed of the vehicle, which is controlled by a diesel engine, which in a typical application, vehicle speed will be approximately 0.24 miles per hour or about 21 feet per minute. Increasing the contact time within the applicator will increase the degree of dryness associated with the sample. Increasing the contact time still further, will result create micro-fractures, in the case of concrete, leading to spalling or breakdown of the aggregate contained within, occurring either simultaneously or sequentially, dependent on the energy associated with the microwaves.

Waveguide Orientation

In a preferred embodiment, the waveguides will be bifurcated and the output of the waveguide sections at the input of the applicator will be positioned at 90° apart with respect to the X and Y axes. In this orientation, the microwaves will be out of phase with respect to each other. It is well known that one can achieve a rotating field vector of constant amplitude and angular velocity by applying linear-polarized microwave sources; i.e., from the output of the bifurcated waveguide, in phase quadrature to two rectangular applicator input ports located 90° out of phase with each other. The result is known as circular polarization. If the applicator inputs are not exactly 90° out of phase with each other, elliptical polarization will occur instead. Through experimentation, it was determined that the most uniform microwave density was produced using the bifurcated waveguide to feed two applicator input ports in a phase quadrature configuration without going to the arc-over point or the voltage breakdown point.

Microwave Frequency

Historically, the frequency of 915 MHz was not originally allocated for use in the Industrial, Scientific and Medical (ISM) applications throughout the world, and no allocation for 915 MHz applications exists today in continental Europe. In addition, only low power magnetrons (<3 kW) were formerly available for 2450 MHz use, while 15-60 kW magnetrons were readily available for 915 MHz use.

Today, magnetron selection from 2.2-60 kW exists at 2450 MHz, while magnetrons operating at 915 MHz are available from 10-200 kW. The preferred frequency of operation for this invention was chosen primarily for penetration depth, increased power availability and reduced number of magnetrons required per applicator. The use of magnetrons operating at 915 MHz and a power of 100 kW results in the most cost effective design for today's applicators. These magnetrons are most readily available from stock, should replacement or rebuild be required.

EXAMPLE #2

In addition to the ability to use the microwave apparatus in the manner described hereinabove, it is also designed for agricultural field applications in that it can reduce herbicides, insecticides and achieves total insect and pathogen destruction. The beneficial materials in the soil such as nitrogen and phosphorus are not affected by microwave excitation. It should be noted that microwave excitation is used, not microwave irradiation since microwave energy is in the radio frequency portion of the spectrum, and therefore is not ionizing radiation as is present with X-rays.

A series of microwave tests were conducted on eight soil samples plant growth, insects and weeds, were received in plastic containers measuring 12½" L×9" W×6" H or approximately 0.39 cubic feet in volume. The soil samples were moist and compacted in the plastic containers. After preliminary review of the samples, an appropriate power density calculation was performed to determine the amount of microwave energy to apply to the soil samples. Each soil sample was carefully removed from its container just prior to placement in the applicator, with initial weight (mass) and temperature recorded. The form of the soil sample "cube" was maintained throughout the testing process. At the end of the exposure period to microwave energy within the applicator, the final mass and temperature were recorded, and the sample form was carefully reinserted into its individual plastic container. The test and design conditions are listed in Table II.

TABLE II

| | Microwave Laboratory Test Conditions | Microwave Design Conditions |
|---|---|---|
| Applicator Specs | 6' L × 5.5' W × 4.33' H (143 $ft^3$) | 16' L × 4' W × 2.25' H (144 $ft^3$) |
| Power Applied | 50 kW Continuous | 20-400 kW Continuous, as determined by onboard Power Density Monitor and actual soil conditions |
| Frequency Applied | 915 MHz | 915 MHz |
| Permittivity of Soil | ~17 | ~2.5-20 |
| Specific Heat of Soil | ~0.24 Btu/lb | ~0.18-0.4 Btu/lb |
| Volume of Soil | 0.39 $ft^3$ | ~43 $ft^3$ |
| Final Moisture | ~0% | As Required by Customer |

The test data obtained from subjecting the rice field soil to high power density microwave energy is summarized in Table III.

TABLE III

| Sample No. | Initial Mass (lbs) | Density (lbs per cu. ft.) | Initial Temp. (° F.) | Final Mass (lbs) | Final Temp. (° F.) | Water Mass (lbs) | Water Content (%) | Microwave Elapsed Time (sec) |
|---|---|---|---|---|---|---|---|---|
| 1 | 25.56 | 65.54 | 83.2 | 22.04 | 249.7 | 3.52 | 13.77 | 105 |
| 2 | 22.98 | 58.92 | 81.2 | 19.82 | 349.0 | 3.16 | 13.75 | 87 |
| 3 | 23.37 | 59.92 | 80.5 | 20.05 | 292.2 | 3.32 | 14.21 | 100 |
| 4 | 22.75 | 58.33 | 81.1 | 19.81 | 306.1 | 2.94 | 12.92 | 72 |
| 5 | 23.73 | 60.85 | 81.9 | 20.29 | 343.5 | 3.44 | 14.50 | 100 |
| 6 | 23.61 | 60.54 | 81.0 | 20.21 | 399.7 | 3.40 | 14.40 | 102 |
| 7 | 24.21 | 62.08 | 79.8 | 20.63 | 357.9 | 3.58 | 14.79 | 90 |
| 8 | 23.35 | 59.87 | 80.3 | 20.97 | 315.0 | 2.38 | 10.19 | 80 |

As determined previously, a linear relationship exists between applied microwave power and soil moisture during the constant drying period. The microwave excitation of soil material results in almost immediate conversion of soil moisture into water vapor, while destroying resident pathogens and most living organisms in the soil. No insects or pathogens were found in the soil samples subsequent to the test. Microwave excitation of plant life results in a dry, brittle, and fragile material, which readily breaks or turns to powder with any force applied. After a three week period of monitoring one of the soil samples, no regrowth of plant life, germination of any new plant life, insects or pathogens have been observed in Sample No. 5, An additional benefit which is achieved in agricultural applications occurs after harvesting. The remaining "straw" in the fields can be reduced to a fragile ash, which contains all of the original soil nutrients, which can be plowed under during the next planting more efficiently. More importantly, the field "straw" or stubble no longer needs to be burned off, reducing air pollution and the chance of a fire spreading to unwanted areas, i.e., other fields or structures.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

What is claimed is:

1. A continuous process for drying a material containing an initial degree of water which comprises the steps of:

(a) driving a vehicle comprising a multi-mode microwave applicator over at least a portion of said material;

(b) exposing said portion of said material to said applicator having an air flow about said portion of said material;

(c) exposing said portion of said material to at least two sources of microwaves, said microwaves being in non-parallel alignment to each other for a period of time sufficient to dry said portion of said material to a lower degree of water;

said at least two sources of microwaves propagated from a bifurcated waveguide assembly;

said introduced microwaves, being 90° out of phase to each other;

said microwaves having a frequency between 915 MHz and 1000 MHz;

said microwave applicator further comprising a 3-port ferrite circulator to absorb any reflected microwaves; and said bifurcated waveguide assembly having a microwave pressure window at an exit end comprising fused quartz to prevent any vapors in the applicator from returning through said waveguide.

2. The process of claim 1 wherein said applicator is heated and operates between approximately 100° F. and 212° F.

3. The process of claim 2 wherein said applicator is heated by a heating means provided from combustion products of engine exhaust gas ducted into and out from the microwave applicator.

4. The process of claim 1 said frequency is approximately 915 MHz.

5. The process of claim 1 wherein said material is a roadbed.

6. The process of claim 1 wherein said material is concrete.

7. The process of claim 1 wherein material is an asphalt surface.

8. The process of claim 1 wherein said material is an agricultural field.

9. A drivable apparatus which comprises:

(a) a movable chassis comprising a microwave generator;

(b) at least one multi-mode microwave applicator in proximity to a material to be dried and in communication with said microwave generator via a waveguide;

(c) said applicator having an air flow about at least a portion of said material;

(d) said applicator having at least two sources of microwaves from said microwave generator, said microwaves being in non-parallel alignment to each other;

said at least two sources of microwaves propagated from a bifurcated waveguide assembly;

said introduced microwaves, being 90° out of phase to each other;

said microwaves having a frequency between 915 MHz and 1000 MHz; and (e) a microwave energy absorber to absorb any reflected microwaves; and (f) said bifurcated waveguide assembly having a microwave pressure window at an exit end comprising fused quartz to prevent any vapors in the applicator from returning through said waveguide.

10. The apparatus of claim 9 wherein said applicator is heated and operates between approximately 100° F. and 212° F.

11. The apparatus of claim 10 wherein said heated applicator is heated by a heating means provided from combustion products of an engine exhaust gas ducted into and out from the microwave applicator.

12. The apparatus of claim 9 said frequency is approximately 915 MHz.

13. The apparatus of claim 9 wherein said microwave energy absorber is a 3-port ferrite circulator.

14. The apparatus of claim 9 which further comprises an RF trap.

* * * * *

UNITED STATES PATENT AND TRADEMARK OFFICE

CERTIFICATE OF CORRECTION

PATENT NO. : 7,607,860 B2
APPLICATION NO. : 11/228173
DATED : October 27, 2009
INVENTOR(S) : John F. Novak It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 566 days.

Signed and Sealed this

Twelfth Day of October, 2010

David J. Kappos

David J. Kappos
*Director of the United States Patent and Trademark Office*